US012729879B2

(12) United States Patent
Yin et al.

(10) Patent No.: US 12,729,879 B2
(45) Date of Patent: Sep. 8, 2026

(54) TANK WATER HEATER AND WATER HEATING SYSTEM

(71) Applicant: A. O. Smith Corporation, Milwaukee, WI (US)

(72) Inventors: Jianmin Yin, Pewaukee, WI (US); Stephen Memory, Menomonee Falls, WI (US)

(73) Assignee: A. O. Smith Corporation, Milwaukee, WI (US)

( * ) Notice: Subject to any disclaimer, the term of this patent is extended or adjusted under 35 U.S.C. 154(b) by 98 days.

(21) Appl. No.: 18/715,513

(22) PCT Filed: Dec. 7, 2022

(86) PCT No.: PCT/US2022/052115

§ 371 (c)(1),
(2) Date: May 31, 2024

(87) PCT Pub. No.: WO2023/107549

PCT Pub. Date: Jun. 15, 2023

(65) Prior Publication Data

US 2025/0146706 A1 May 8, 2025

Related U.S. Application Data

(60) Provisional application No. 63/287,682, filed on Dec. 9, 2021.

(51) Int. Cl.

| | |
|---|---|
| ***F24H 4/04*** | (2006.01) |
| ***F24H 1/18*** | (2022.01) |
| ***F24H 9/13*** | (2022.01) |

(52) U.S. Cl.

CPC ..... *F24H 4/04* (2013.01); *F24H 1/181* (2013.01); *F24H 9/133* (2022.01)

(58) Field of Classification Search

CPC ..... F28D 20/0039; F28D 2020/0086; F24H 4/02; F24H 4/04; F24H 1/181; F24H 9/133

(Continued)

(56) References Cited

U.S. PATENT DOCUMENTS

| | | | |
|---|---|---|---|
| 1,880,255 | A | 10/1932 | Johnson |
| 2,785,274 | A | 3/1957 | Andrus |

(Continued)

FOREIGN PATENT DOCUMENTS

| | | | |
|---|---|---|---|
| CN | 206618122 | U | 11/2017 |
| DE | 4317441 | A1 | 12/1994 |

OTHER PUBLICATIONS

International Search Report and Written Opinion for Application No. PCT/US2022/052115 dated Apr. 14, 2023 (6 pages).

(Continued)

*Primary Examiner* — Steve S Tanenbaum

(74) *Attorney, Agent, or Firm* — Michael Best & Friedrich LLP

(57) ABSTRACT

A water heater includes first and second cylindrical tank portions, a water outlet stub, and a connecting pipe. The first cylindrical tank portion is capped by a first domed head at a first end of the first cylindrical tank portion and a second domed head at a second end of the first cylindrical tank portion. The water outlet stub is connected to the first domed head. The second cylindrical tank portion is capped by a third domed head at a first end of the second cylindrical tank portion and a fourth domed head at a second end of the second cylindrical tank portion. The first and second domed heads each have an inwardly facing concave surface and an outwardly facing convex surface. The third and fourth domed heads each have an outwardly facing concave surface and an inwardly facing convex surface.

17 Claims, 3 Drawing Sheets

(58) Field of Classification Search
USPC ..... 62/238.1
See application file for complete search history.

(56) References Cited

U.S. PATENT DOCUMENTS

| | | | | |
|---|---|---|---|---|
| 4,598,694 | A * | 7/1986 | Cromer | F24H 1/18 126/640 |
| 5,383,566 | A | 1/1995 | Johnson | |
| 6,553,947 | B2 * | 4/2003 | Bradenbaugh | F24H 9/133 122/13.3 |
| 10,288,316 | B1 * | 5/2019 | Currey | F24H 9/45 |
| 2016/0097546 | A1 * | 4/2016 | Tsai | F24D 19/1054 122/15.1 |
| 2021/0041142 | A1 * | 2/2021 | Steffes | F25B 6/04 |

OTHER PUBLICATIONS

International Preliminary Report on Patentability for Application No. PCT/US2022/052115 dated Jun. 5, 2024 (5 pages).

* cited by examiner

TANK WATER HEATER AND WATER HEATING SYSTEM

CROSS-REFERENCE TO RELATED APPLICATIONS

This application claims priority to U.S. Provisional Patent Application No. 63/287,682, filed on Dec. 9, 2021, the entire contents of which are hereby incorporated by reference.

BACKGROUND

The present invention relates to water heaters, and more particularly to residential and commercial tank storage water heaters.

Depending on the water temperature inside a water heater tank, if only small amounts of water are used from the water heater tank, colder water resting at the bottom of the water heater tank will tend to slowly cool the hot water at the top of the water heater tank. This occurs primarily due to conduction along the tank wall, which can be made of steel, and conduction and/or convection between the water volume in the tank across the tank's cross-sectional area.

Thermal energy stored within the tank can also be lost to the environment, such lost thermal energy being referred to as standby loss. Typically, the outer periphery of the tank is surrounded with thermal insulation in order to minimize such standby losses. However, as the relatively heavy (particularly when it is filled with water) tank needs to be structurally supported, it becomes difficult to minimize the thermal conduction path through the bottom portion of the tank to the structure on which it is supported (for example, a cold concrete floor). Such standby loss effects are exacerbated by the tank wall conduction, which draws heat from the upper portion of the tank to the lower portion, where it can be more readily lost.

Even when the standby losses are kept relatively low, the amount of available water above a useful temperature, e.g., 105 degrees Fahrenheit, may be reduced by the tank wall conduction effects. Accordingly, a need exists for a water heater for use with long "off" periods and periods of little demand response that can minimize the cool down of the upper hot water volume. Stated otherwise, a need exists for a highly stratified tank that remains highly stratified with time.

SUMMARY

A water heater tank according to the present disclosure provides advantageous solutions to these and other known problems in the art. A water heater tank is provided, where the water heater tank is divided into stacked upper and lower tanks. A separating wall is provided to separate the upper tank from the lower tank.

Cold water enters the tanks through a dip tube passing through the upper tank and extending through an annulus in the separating wall to empty into the lower tank. Cold water can additionally or alternatively enter the tanks through an inlet into the lower tank in a sidewall of the tank. Hot water is drawn from the top of the upper tank. This is the "useable" hot water.

As useable hot water is drawn from the top of the tank, a water heating system operates to maintain the top of the tank above a useful temperature. The whole of the top tank is preferably filled with useable hot water. Warm water will seep through the annulus between the central spud and the dip tube. In at least some embodiments, heat traps within the dip tube avoid hot water passing back into the lower, colder tank. In this way, a barrier is produced between the relatively warmer water in the upper tank and the relatively cooler water in the lower tank.

As a result of the construction of the water heater tank provided herein, a highly stratified water tank is produced. While the total energy in the tanks is about the same as traditional water heater with a single tank, the upper tank as provided herein will maintain a larger amount of water above the usable temperature than a traditional water tank because of the barrier between the upper and lower tanks.

In one aspect, a tank water heater is provided. The tank water heater includes first and second cylindrical tank portions, a water outlet stub, and a connecting pipe. The first cylindrical tank portion has a vertically oriented first central axis, and is capped by a first domed head at a first end of the first cylindrical tank portion and a second domed head at a second end of the first cylindrical tank portion. The water outlet stub is connected to the first domed head. The second cylindrical tank portion has a second central axis. The second central axis is aligned with the first central axis. The second cylindrical tank portion is capped by a third domed head at a first end of the second cylindrical tank portion and a fourth domed head at a second end of the second cylindrical tank portion.

In some embodiments, the connecting pipe extends along the first and second central axes between the second domed head and the third domed head to fluidly connect the first and second cylindrical tank portions. The first and second domed heads each have an inwardly facing concave surface and an outwardly facing convex surface. The third and fourth domed heads each have an outwardly facing concave surface and an inwardly facing convex surface.

In another aspect, a water heating system includes a hot water storage tank. The hot water storage tank has a first tank portion and a second tank portion. The first tank portion and the second tank portion both have cylindrical outer walls. The second tank portion is arranged below the first tank portion, with an insulating wall between them. A connecting pipe extends through the insulating to fluidly connect the first tank portion and the second tank portion. A first refrigerant coil is wrapped around the cylindrical wall of the first tank portion, and a second refrigerant coil is wrapped around the cylindrical wall of the second tank portion.

The water heating system is configured to operate in at least a first mode and a second mode. In the first mode of operation, water contained within both the first tank portion and the second tank portion is heated by refrigerant flowing through the first refrigerant coil and the second refrigerant coil. In the second mode of operation, only water contained in one of the two tank portions is heated by refrigerant flowing through the refrigerant coils.

In some such embodiments, only the water contained within the first tank portion is heated by refrigerant when the water heating system is operating in the second mode. In other such embodiments, only the water contained within the second tank portion is heated by refrigerant when the water heating system is operating in the second mode.

In some embodiments, the water heating system is configured to operate in a third mode. In the third mode, water contained within the tank portion that is not heated when the system operates in the second mode is heated in the third mode.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Also, it is to be understood that the phraseology and terminology used herein is for the purpose of description and should not be regarded as limiting. The modifier "about" used in connection with a quantity is inclusive of the stated value and has the meaning dictated by the context (for example, it includes at least the degree of error associated with the measurement of the particular quantity). The modifier "about" should also be considered as disclosing the range defined by the absolute values of the two endpoints. For example, the expression "from about 2 to about 4" also discloses the range "from 2 to 4". The term "about" may refer to plus or minus 10% of the indicated number. For example, "about 10%" may indicate a range of 9% to 11%, and "about 1%" may mean from 0.9-1.1. Other meanings of "about" may be apparent from the context, such as rounding off, so, for example "about 1" may also mean from 0.5 to 1.4.

Figure 1:
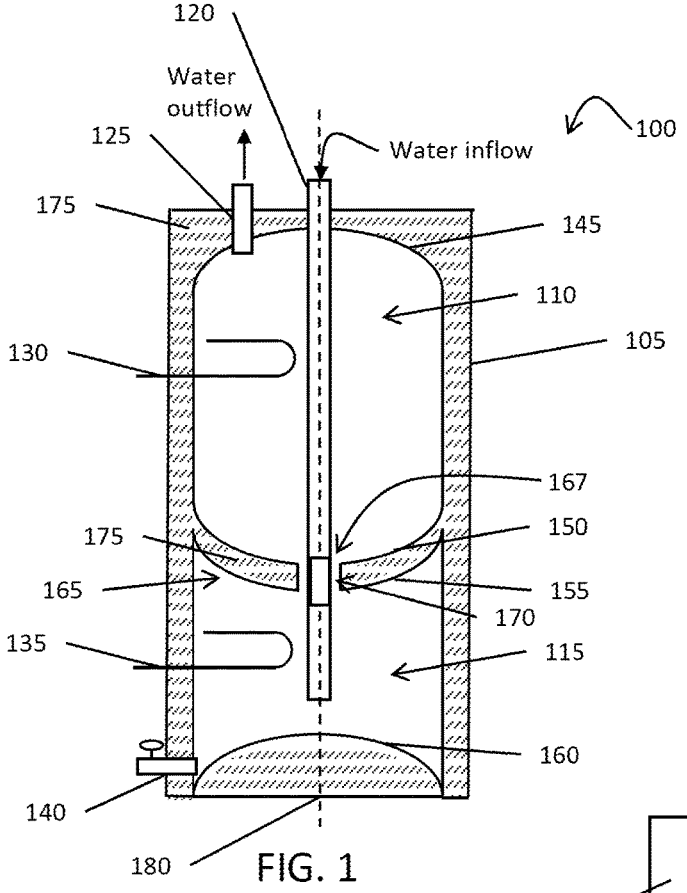
FIG. 1 is a perspective view of a water heater according to a first construction.

FIG. 1 illustrates a perspective view of a water heater 100. The water heater 100 has a shell 105 having therein an upper tank 110 and a lower tank 115. Insulating foam or thermal insulation 175 fills the annular space between the water tanks 110, 115 and the shell 105 to reduce conduction between the tanks 110, 115 and the shell 105. The tanks 110, 115 are made of ferrous metal and lined internally with a glass-like porcelain enamel to protect the metal from corrosion. Alternatively, the tanks 110, 115 can be constructed of a corrosion-resistant material such as stainless steel.

A water inlet line or dip tube 120 extends from outside the shell 105, through the upper tank 110, and into the lower tank 115. The water inlet line or dip tube 120 adds cold water to the water heater 100 to replace heated water that is removed from the tanks during a water draw. A water outlet line 125 extends from the upper tank 110 to outside the shell 105. The water outlet line 125 carries heated water away from the water heater 100 for use during a water draw. The water inlet line 120 and water outlet line 125 extend through a top (i.e., with respect to gravity in the orientation of the water heater 100 shown in FIG. 1) and are parallel to a central axis 180 of the upper tank 110 and the lower tank 115. The water inlet line 120 and the water outlet line 125 are preferably spaced at least eight inches apart. Flexible tubing can be used to space the water outlet line 125 and the water inlet line 120 even after the lines exit the proximity of the water heater 100. The upper tank 110 and the lower tank 115 are aligned along the central axis 180 such that central axes of each of the upper and lower tanks 110, 115 are also aligned.

Figure 2:
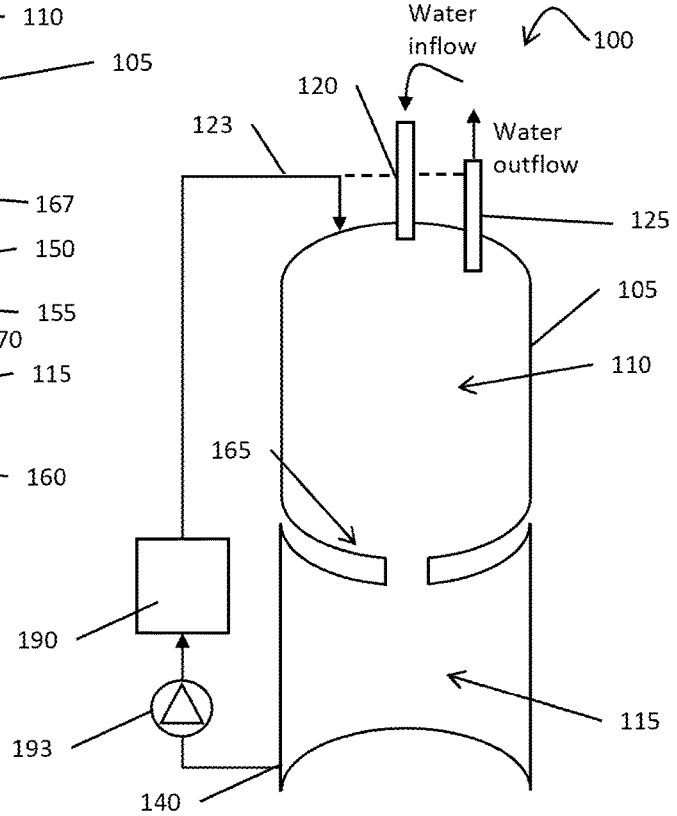
FIG. 2 is a perspective view of a water heater according to a second construction that may be combinable with the first construction.
Figure 3:
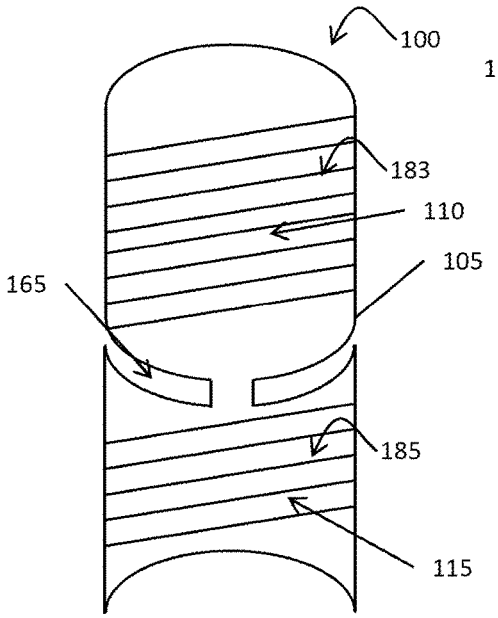
FIG. 3 is a perspective view of a water heater according to a third construction that may be combinable with the first and second constructions.

The upper tank 110 includes an upper heating element 130 and the lower tank 115 includes a lower heating element 135 that heat the water within the tanks 110, 115. The upper and lower heating elements 130, 135 are electric resistance heating elements, which typically include an internal high resistance heating element wire surrounded by a suitable insulating material and enclosed in a metal jacket, and extend into the water volume within the respective upper or lower tank 110, 115 such that they are immersed in the water. Electric power for the heating elements 130, 135 is typically supplied from a control circuit. While a water heater 100 having elements 130, 135 is shown in FIG. 1, other devices for heating the water within the water heater 100 are contemplated. For example, the water heater 100 could alternatively be a gas water heater. Other exemplary heating devices are illustrated in FIGS. 2 and 3, which are discussed in more detail below.

The upper tank 110 has a first domed head 145 and a second domed head 150. The first and second domed heads 145, 150 of the upper tank 110 each have an inwardly facing concave surface and an outwardly facing convex surface (sometimes referred to as a plus/plus configuration). The first and second domed heads 145, 150 are aligned along the central axis 180 at upper and lower portions of the upper tank 110. In this way, the upper tank 110 is a generally cylindrical structure aligned with the central axis 180 and that is capped by the first and second domed heads 145, 150.

The lower tank 115 has a first domed head 155 and a second domed head 160. The first and second domed heads 155, 160 of the lower tank 115 are aligned along the central axis 180 at upper and lower portions of the lower tank 115. In this way, the lower tank 115 is a generally cylindrical structure aligned with the central axis 180 and that is capped by the first and second domed heads 155, 160. In contrast to the upper tank 110, the first and second domed heads 155, 160 of the lower tank 115 each have an outwardly facing concave surface and an inwardly facing convex surface (sometimes referred to as a minus/minus configuration).

The outwardly facing convex surface of the upper tank second domed head 150 and the outwardly facing concave surface of the lower tank first domed head 155 advantageously allow the upper and lower tanks 110, 115 to be vertically stacked along the central axis 180. This configuration maximizes the water volume within a given overall height. As a result, the footprint created by the water heater 100, i.e., the area of the shell 105, allows for easy retrofit installation of the water heater 100 as a replacement for a failed or less desirable tank water heater having similar water capacity.

An added advantage of the minus/minus configuration of the lower tank 115 is that the lower tank second domed head 160 allows for nearly complete drainage from the lower tank 115. An alternative water outlet connector 140 is placed at a circumferential position on the lower tank 115, preferably as low as possible (i.e., as far away from the upper tank 110 as possible). The alternative water outlet connector 140 allows water to be drained from the lower tank 115 and, because the shape of the lower tank second domed head 160 displaces fluid within the lower tank 115 toward the outer circumference of the lower tank 115, nearly all of the water in the lower tank 115 is drainable from the alternative water outlet connector 140. Draining the water heater 100 in such a manner is desirable when, for example, the water heater 100 needs to be emptied for service or replacement.

Contrasting this configuration with an outwardly convex tank bottom or a flat tank bottom, more water will be retained in the tank within the domed outwardly convex portion of the tank or in the area between any offset of the alternative water outlet connector 140 from the flat bottom of the tank. To remedy this problem, the alterative connector can be placed at the bottom, center of the tank (i.e., along the vertical, central axis 180 and at the bottom of the tank with respect to gravity as the tank is shown in FIG. 1). However, this center location is more difficult to access by a user, creates an uneven base of the water heater 100, and tends to increase manufacturing cost because additional plumbing is required to access the center-located alternative water outlet connector 140.

The upper tank second domed head 150 and the lower tank first domed head 155 together create a separating wall 165 between the upper and lower tanks 110, 115. Insulating foam or thermal insulation 175 is located between the upper tank second domed head 150 and the lower tank first domed head 155 to reduce conduction therebetween. Advantageously, there is no metal contact between the cylindrical walls of the upper tank 110 and the lower tank 115 to minimize conduction between the two tanks. The thickness of the insulation 175 is approximately constant between the upper tank second domed head 150 and the lower tank first domed head 155, and is selected so as to provide a sufficient thermal break between the two tanks with a minimal volume, as the volume consumed by that insulation is not available for heated water storage. The separating wall 165 has therein a separating wall opening or "spud" 167, which is located along the central axis 180 and defines a connecting pipe between the two tanks 110, 115. The dip tube 120 passes through the separating wall opening 167 to extend from the upper tank 110 and into the lower tank 115.

In an alternative embodiment, upper and lower tanks 110, 115 could also be 'regular' or 'standard' tanks (i.e. each tank has an upper outwardly convex head and a lower outwardly concave head) to reduce manufacturing costs. However, this will not allow full drainage from the upper tank 110 into the lower tank 115 (e.g., when the tank is drained of water for removal or service) unless the separating wall opening 167 is moved to an outer circumference, with respect to the central axis 180, of the separating wall 165. Otherwise, water will be retained in an annular region around the outwardly concave upper tank second domed head 150 because this annular region will be below, with respect to gravity, the separating wall opening 167.

The ratio of volumes of the upper and lower tanks 110, 115 can be optimized to provide a suitable first-hour rating (FHR). The FHR is the capacity of hot water (i.e. water that is at a desired delivery temperature such as 140° F.) that a water heater can deliver within an hour, when starting filled with hot water. As hot water is drawn from the upper tank 110, it is replaced with cold water that enters the lower tank 115. The restricted separating wall opening 167 prevents or minimizes any mixing between the incoming cold water and the stored hot water, allowing the cold water to be heated to the desired temperature as the stored hot water is depleted. Optimizing efficiency and FHR may yield a larger upper tank 110 volume compared to the lower tank 115 volume.

It has been found that a significant amount of the standby heat loss from a conventional water heater tank is by conduction from the bottom of the tank to the ground or other support surface upon which the weight of the fully loaded water heater tank is supported. Often, a water heater is placed on a cold, thermally conductive surface, such as for example a concrete slab. The heavy weight of the metal tank and the water contained within it makes it difficult to provide adequate thermal insulation between the tank and such a surface, since thermal insulation tends to lack the requisite structural strength to function as a support member. The water heater 100 is able to mitigate the undesirable effects of such conductive standby losses by interrupting the thermal conduction path from the upper portion of the water heater 100 to the lower portion. Specifically, the separating wall 165 substantially prevents the undesirable conduction of heat from the cylindrical wall of the upper tank 110 to the support surface. As heat is lost to the support surface by thermal conductivity from the cylindrical wall of the lower tank 115, the tank wall temperature will decrease, and will tend to cool the water contained in that lower tank 115. The temperature of the cylindrical wall in the upper tank 110, however, will be unaffected by such losses, and consequently the temperature of the water contained in that upper tank 110 will be unaffected.

In the embodiment shown in FIG. 1, water is heated in the upper tank 110 by an upper heating element 130 and water is heated in the lower tank 115 by a lower heating element 135. The upper and lower heating elements 130, 135 are electric heating elements. FIGS. 2 and 3 illustrate alternative methods and devices for heating the water within the water heater 100. These alternative methods include an external heating apparatus or heat engine 190 (FIG. 2) or refrigerant coils 183, 185 (FIG. 3). Such alternative heating devices, and the methods of heating associated therewith, can be used with the other heating devices and methods disclosed herein, or can be used as standalone heating methods, i.e., without the other heating devices and methods disclosed herein.

FIG. 2 illustrates an external heating apparatus, i.e., a heat engine 190. A heating circuit includes the alternative water outlet connector 140 located at the bottom portion of the lower tank 115, the heat engine 190, a pump 193, and a second water inlet line 123. The heat engine can be, for example, a gas-fired tankless water heater, an electric element water heater, a heat-pump water heater, or any other type of boiler or water heater.

The pump 193 pumps water from the alternative water outlet connector 140, through the heat engine 190, and to the second water inlet line 123. Since the coldest water in the water heater 100 will tend to sit at the bottom of the lower tank 115, the alternative water outlet connector 140 is preferably connected as low as possible in the lower tank 115. This results in the coldest water in the water heater 100 being heated by the heat engine 190, and subsequently being delivered to the top of the upper tank 110.

Furthermore, in some embodiments, one or more heat engines 190 may be positioned on or within the tanks 110, 115 for heating the water within the tanks 110, 115. When the water heater 100 is operating with the pump 193 activated and moving water from a lower portion of the lower tank 115, through the heat engine 190, and back to the upper tank 110, the water heater 100 is in a charging mode in which it is increasing the volume of hot water in the tanks 110, 115.

The second water inlet line 123 may deposit water directly into the water heater 100, or may supply water to the water heater 100 via the outlet line 125. In the case where the second water inlet line 123 supplies water to the outlet line 125, the second water inlet line 123 supplies water into the outlet line 125 via a T-junction outside of the water heater 100. This T-junction can also take the form of a switch that toggles between placing the outlet line 125 in communication with a hot water supply pipe to the building or in communication with the second water inlet line 123. In this regard, the term "T-junction" will be used to broadly cover both a basic T-junction and a switch.

The embodiment of FIG. 2 can be configured as a split tank heating system, wherein the tanks 110, 115 are used to store water that is heated externally by the heat engine 190. When there is no water draw through the water outlet line 125, cold water from the bottom end of the lower tank is slowly heated by the heat engine 190 and is reintroduced to the top end of the upper tank 110. Water from the upper tank 110 pushes down through the separating wall opening 167 and refills the lower tank 115. When a draw starts, the hot water produced by the heat engine 190 can be directly drawn from the inlet line 123 through the T-junction and out through the outlet line 125 to meet the demand. If the draw is larger than the amount of hot water being produced by the heat engine 190, the cold water entering through the dip tube 120 from the bottom of the lower tank 115 pushes additional heated water up and out of the top of the upper tank 110 through the water outlet line 125.

FIG. 3 illustrates yet another apparatus for heating the upper and lower tanks 110, 115. In FIG. 3, an upper refrigerant coil 183 and a lower refrigerant coil 185 wrap around the shell 105 of the upper and lower tanks 110, 115, respectively. In some embodiments, the upper and lower refrigerant coils 183, 185 are part of the same refrigerant circuit, and are therefore connected to heat the entire water heater 100. In other embodiments, the upper and lower refrigerant coils 183, 185 are part of different refrigerant circuits. In this case, the different refrigerant circuits are controlled to provide variable heating to the upper and/or lower tanks 110, 115. For example, if water in the upper tank 110 is already at or above a useful temperature of the water, then the upper refrigerant coil 183 may be in an "off" or reduced power state. As another example, if backfill water is flowing into the lower tank 115, the lower refrigerant coil 185 may be in a maximum heating state, where a maximum amount of heat is applied to the lower tank 115. As yet another example, if water in the upper tank 110 is not yet at or above a usable temperature, the upper refrigerant coil is put in a maximum power state (i.e., a "quick heat" setting) to ensure that draw from the water heater 100 will be at the expected temperature by a user. Variable heating can be applied to other heating devices, such as the upper and lower heating elements 130, 135 as shown in FIG. 1. In some embodiments, a water heater may have combinations of one or both refrigerant coils 183, 185 and one or both heating elements 130, 135.

Figure 4:
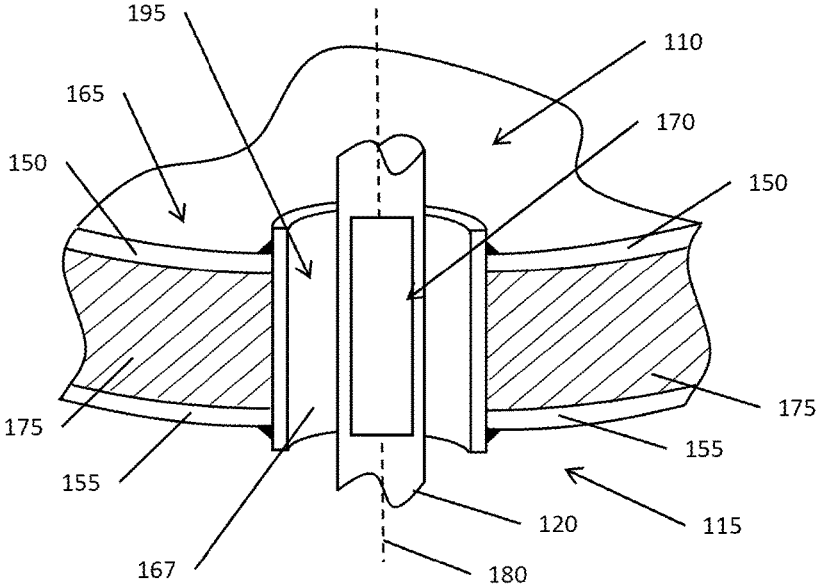
FIG. 4 is a detail view of a central portion of the water heater of FIG. 1.

FIG. 4 illustrates a detail view of the water heater 100, and more specifically illustrates the region where the dip tube 120 passes through the separating wall opening 167. An annular gap or flow path 195 exists between the dip tube 120 and the portions of the separating wall 165 that define the separating wall opening 167. The annular gap 195 allows fluid to pass between the upper tank 110 and the lower tank 115. It is desirable to minimize the cross-sectional area of the annular gap 195 to minimize the thermal conduction between the water in the upper tank 110 and the water in the lower tank 115, while maintaining adequate flow area to keep the flow velocity to an acceptable level during a water draw. Preferably, diameters of the upper and/or lower tanks 110, 115 taken perpendicular to the direction of extension of the central axis 180 are at least five times a diameter of the annular gap 195. In other embodiments, numerous separating wall openings are provided through the separating wall 165.

In general, as fluid or water is needed by a user, it is removed from the upper tank 110. The fluid could be removed via the water outlet line 125, which is not shown in FIG. 4. The water in the upper tank 110 is ideally above a useful temperature (e.g. 120° F., or higher) so that water is predictably warm when requested by a user (e.g., by turning on a hot water tap). As the water is removed, water must be backfilled into the upper tank 110. This backfilled water must then be heated so that it is above the useful temperature and ready for use. The backfilled water ultimately comes from the dip tube 120, which provides unheated water to the lower tank 115. This unheated water is gradually heated by, for example, the lower heating element 135 or the lower refrigerant coil 185. Since warmer water tends to rise relative to colder water, the heated water in the lower tank 115 gradually rises in the lower tank 115 and moves toward the annular gap 195. As even more unheated water is backfilled into the lower tank 115, it is the warmer water near the top of the lower tank 115 that moves through the annular gap 195 to replace the water removed via the water outlet line 125.

This configuration is advantageous because only warmer water from the lower tank 115 is used to refill water in the upper tank 110. The separating wall 165 effectively creates a barrier between the newly backfilled water in the lower tank 115, which is at a relatively lower temperature, and the water above a useful temperature in the upper tank 110, which is at a relatively higher temperature than the water in the lower tank 115. This results in a higher percentage of the water in a state that is above a useful temperature because water entering the upper tank has been effectively preheated by the lower tank and is already near or at the useful temperature. This is true even though the amount of energy in the water heater 100 (i.e., the amount of heat retained in the water heater 100 at a given time) is near or the same as that of a traditional water heater.

In some situations, a large draw of hot water from the water heater 100 can leave the water heater 100 with a substantial amount of cold water that needs to be heated to the desired temperature over time. In the exemplary embodiments, the volume of cold water will be concentrated within the lower tank 115, and the volume of remaining hot water will be concentrated within the upper tank 110. Due to convection between the water and the tank walls, the cylindrical wall of the lower tank 115 will then be substantially cooler than the cylindrical tank wall of the upper tank 110. The insulating wall 165 between the upper and lower tanks will then serve as an effective thermal break between those two cylindrical tank walls, preventing the undesirable conduction of heat from the wall of the upper tank 110 to the wall of the lower tank 115 which would tend to cool the hot water in the upper tank 110.

As shown in FIG. 4, a heat trap 170 is positioned within the dip tube 120. The heat trap 170 may be a double-sided heat trap to prevent convection along the dip tube 120 at the joining section of the upper and lower tanks 110, 115. In other words, the heat trap 170 allows cold water to pass through the dip tube 120 and into the lower tank 115, but prevents relatively warmer water from passing back up through the dip tube 120. Such a heat trap 170 can further prevent the undesirable migration of heat from the warmer water in the upper tank 110 to the colder water in the lower tank 115.

Figure 5B:
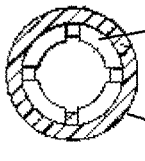
FIG. 5B is another section view illustrating a valve seat of the heat trap of FIG. 5A.
Figure 5A:
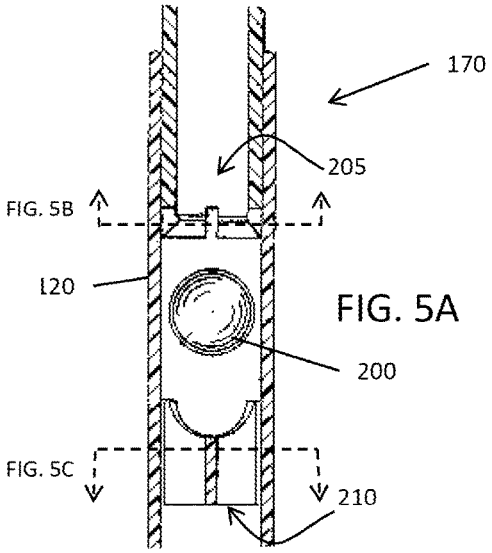
FIG. 5A is a section view of a heat trap.
Figure 5C:
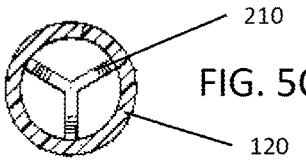
FIG. 5C is another section view illustrating a retainer of the heat trap of FIG. 5A.

An exemplary heat trap 170 is shown in detail in FIGS. 5A to 5C. The heat trap 170 includes a movable sealing member in the form of a ball 200. The ball 200 has a density less than 1.0 such that it floats in water. When there is no draw of water from the water heater 100, the ball 200 floats up to engage an upper valve seat 205. This seals the dip tube 120 such that any conductive or convective heat transfer between warmer water in the portion of the dip tube 120 within the upper tank 100 and colder water in the lower tank 115 is minimized. As a result, the ball 200 engaging the upper valve seat 205 advantageously increases the stratification in the water heater 100.

As backfill water is pushed through the dip tube 120, the ball 200 will move down with the flow of backfill water to engage a retainer 210. The force of buoyancy of the ball 200 created by the ball's density being less than 1.0 is less than the force from the flow of water through the dip tube 120 acting on the ball 200. As a result, the ball engages the retainer 210 as a result of the force of the flowing backfill water. As the retainer 210 engages the ball 200, water is able to flow around the ball 200 and past the retainer 210 to reach the lower tank 115. In other words, the ball 200 engaging the retainer 210 does not seal the dip tube 120 in the same way as the dip tube 120 is sealed when the ball 200 floats to engage the upper valve seat 205.

Figure 6:
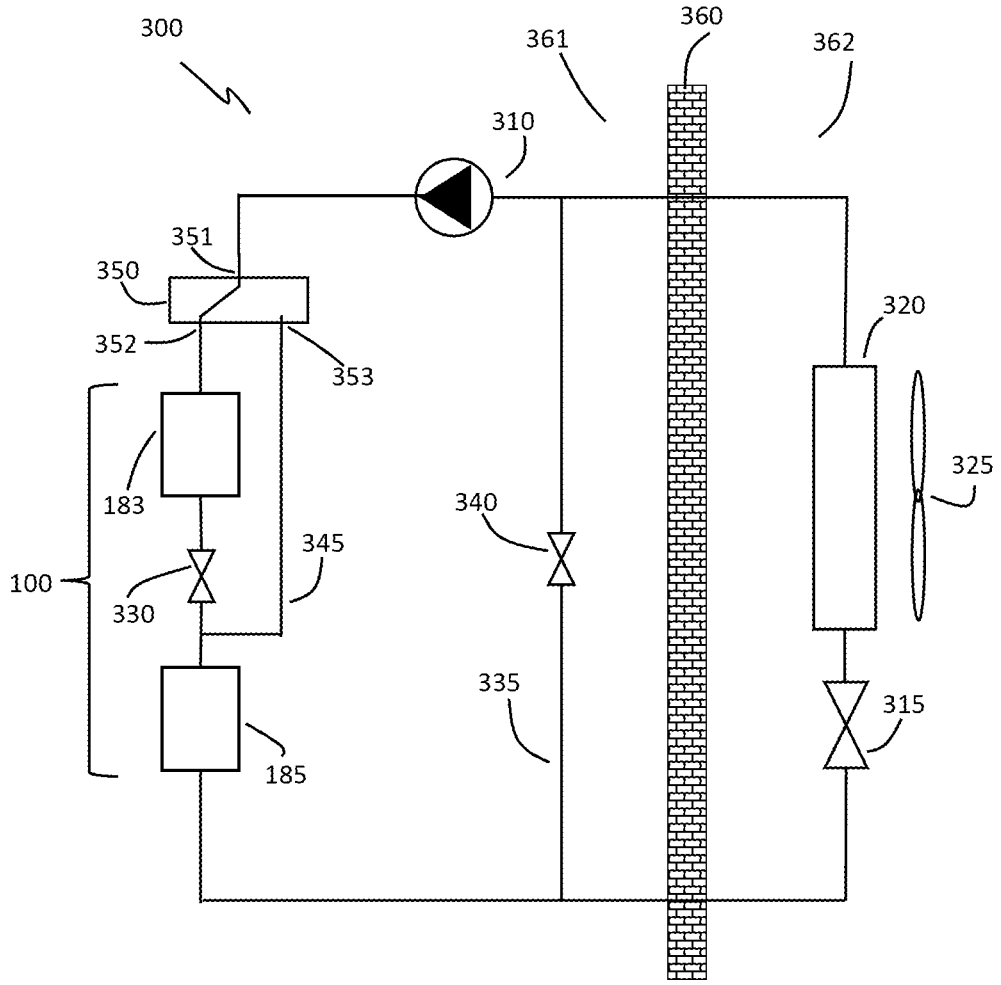
FIG. 6 is a schematic of a water heating system incorporating the water heater of the third construction.

The water heater 100 can be advantageously used, in some embodiments, to intentionally stratify the water into a higher temperature upper tank 100 and a lower temperature lower tank 115. The schematic diagram of FIG. 6 depicts a water heating system 300 that is capable of operating in such a manner, particularly by using the water heater 100 of FIG. 3. The water heater system 300 is a split heat pump system, with a portion of the system 300 residing within a relatively controlled first environment 361, and with another portion of the system 300 residing within a relatively uncontrolled second environment 362. By way of example, the first environment 361 can be an indoor space and the second environment 362 can be an outdoor space, the two being separated from one another by one or more walls 360. It should be understood that the controlled first environment 361 can be a fully conditioned space (for example, a kitchen, bathroom, or other living space), or a partially conditioned space (for example, a basement), or a generally unconditioned space (for example, a garage). As shown in FIG. 6, the refrigerant circuit extends through the walls 360 between the environments 361, 362.

The water heating system 300 includes the upper refrigerant coil 183 and the lower refrigerant coil 185 that were previously described with reference to the water heater 100 as shown in FIG. 3. That water heater 100 is arranged within the controlled environment 361. The water heating system 300 further includes a compressor 310, a switching valve 350, and a bypass line 335 within the controlled environment 361. An evaporator 320, fan 325, and expansion valve 315 are arranged within the uncontrolled environment 362.

In a first mode of operation of the water heating system 300, the switching valve 350 is in the operating state shown in FIG. 6, wherein a first valve port 351 (in fluid communication with the outlet of the compressor 310) is connected to a second valve port 352 (in fluid communication with an inlet of the upper refrigerant coil 183). A throttling valve 330, arranged between the outlet of the upper refrigerant coil 183 and the inlet of the lower refrigerant coil 185, is fully open so as to not restrict the flow of refrigerant therethrough. A shut-off valve 340 along the bypass line 335 is in a closed position to prevent refrigerant flow through the bypass line 335.

In this first mode of operation, high-pressure liquid refrigerant is expanded within the expansion valve 315 to a low-pressure, two-phase state, and is vaporized within the evaporator 320 to a low-pressure vapor state by heat sourced from a flow of air that is directed through the evaporator 320 by the fan 325. The low-pressure vapor is compressed by the compressor 310 to a high-pressure vapor state. The high-pressure refrigerant vapor is directed by the compressor to the water heater 100, and is condensed to a liquid state as it passes through the upper and lower refrigerant coils 183, 185 by transferring heat through the tank walls to the water contained within the tanks 110, 115, thereby heating that water to a desired temperature. The cooled and condensed liquid refrigerant is then returned to the expansion valve 315 to complete the cycle.

The heat pump water heating system 300 can achieve highly efficient performance levels by sourcing heat at a relatively low temperature (i.e. the ambient air temperature of the uncontrolled environment 362). However, in order to ensure adequate water temperatures within the water heater 100 (e.g. water at a temperature setpoint of 120° F. or higher), the compressor 310 must be capable of raising the pressure of the vapor refrigerant from a first pressure (which is low enough that the boiling point of the refrigerant is below the relatively low temperature of the environment 362) to a second pressure high enough that the boiling point of the refrigerant is above the desired water temperature. When the ambient temperature of the environment 362 drops too low (as may happen during winter times in colder climates), the compressor 310 may not be capable of delivering the refrigerant to the water heater 100 at the desired pressure. By way of example, when the ambient temperature in the environment 362 is well below freezing, the compressor may only be able to deliver the refrigerant at a condensing temperature of around 90° F., a temperature which is unsuitable for hot water.

Under such conditions, the water heating system 300 can switch to a second mode of operation. In this second mode of operation, the valve 340 along the bypass line 335 is opened so that the refrigerant bypasses the expansion valve 315 and the evaporator 320 and circulates only within the controlled environment 361. The throttling valve 330 partially closes, such that the throttling valve 330 acts as an expansion valve to drop the pressure of the refrigerant before it reaches the lower coil 185. The lower coil 185 thus acts as an evaporator for the refrigerant in this second mode of operation, and the refrigerant is evaporated as it passes through the lower coil 185 by receiving heat from the water within the lower tank 115. The evaporated refrigerant passes through the bypass line 335 to the compressor 310, and is compressed and delivered to the upper refrigerant coil 183, which acts as the condenser. The heat source for the evaporator (i.e. the water in the lower tank 115) is at a temperature that allows for a relatively high evaporation pressure, which consequently allows the compressor 310 to compress the refrigerant to a pressure that is suitable for heating the water in the upper tank 110 to the desired setpoint (e.g. 120° F.). Thus, in this second mode of operation, thermal energy is pumped from the lower tank 115 to the upper tank 110 in order to intentionally stratify the water heater 100 into an upper volume of water at a high temperature and a lower volume of water at a low temperature.

Since the cylindrical outer walls of upper tank portion 110 and the lower tank portion 115 are thermally decoupled from one another by the insulating layer 165 between them, such an intentional temperature stratification between the two tank portions is more readily achievable. As the only thermal conduction path is the conduction path through the connecting pipe 167, which provides a relatively small conduction area, the two tanks can be maintained at highly different temperature without heat being readily transferred between them.

Once the water contained within the upper tank 110 has reached the desired setpoint temperature, the water heating system 300 can be operated in a third operating mode in order to heat the water contained in the lower tank 115. By virtue of operating in the second mode of operation, wherein thermal energy is pumped from the lower tank 115 to the upper tank 110, the water that is contained within the lower tank 115 may be at a substantially lower temperature than is desirable. In some instance, the water in the lower tank 115 may be at or below the entering cold water temperature. In the third mode of operation, the shutoff valve 340 along the bypass line 335 is once again closed, so that refrigerant is once more directed to those portions of the refrigerant circuit located in the uncontrolled environment 362. The switching valve 350 is placed into an operating state where the first valve port 351 is connected to a third valve port 353. The third valve port 353 directs the compressed refrigerant along a line 345 that bypasses the upper refrigerant coil 183, and that connects upstream of the inlet to the lower refrigerant coil 185. The throttling valve 330 can be fully closed in this third mode of operation.

When the water heating system 300 operates in this third mode of operation, heat sourced from the ambient air in the unconditioned environment 362 is used to evaporate refrigerant at a low pressure as it passes through the evaporator 320. That low pressure vapor refrigerant is then compressed by the compressor to a high-pressure vapor state, and is directed to lower refrigerant coil 185 via the bypass line 345, bypassing the upper refrigerant coil 183. Due to the low-temperature conditions in the unconditioned environment 362, the condensing pressure of the refrigerant as it passes through the lower refrigerant coil 185 in this third mode of operation is likely insufficient to heat the water in the lower tank 115 to the desired hot water temperature setpoint. However, it can heat the cold water in that tank 115 to a lower setpoint temperature, such as (for example) 90° F. Once the water in the lower tank 115 has reached this setpoint temperature, the compressor 310 is stopped and the water heating system 300 enters into a standby mode.

Although the invention has been described in detail with reference to certain preferred embodiments, variations and modifications exist within the scope and spirit of one or more independent aspects of the invention as described.

What is claimed is:

1. A water heating system, comprising:

a hot water storage tank comprising:

a first tank portion having a first cylindrical outer wall;

a second tank portion having a second cylindrical outer wall, the second tank portion being arranged below the first tank portion, a central axis of the second tank portion being aligned with a central axis of the first tank portion;

a thermal insulation layer arranged between the first tank portion and the second tank portion, the thermal insulation layer separating the first cylindrical outer wall from the second cylindrical outer wall; and a connecting pipe extending through the thermal insulation layer along the central axes of the first and second tank portions to fluidly connect the first and second tank portions;

a first refrigerant coil wrapped around the first cylindrical outer wall of the first tank portion; and a second refrigerant coil wrapped around the second cylindrical outer wall of the second tank portion, wherein the water heating system is configured to selectively operate in at least a first mode and a second mode, water contained within both the first tank portion and the second tank portion being heated by refrigerant passing through the first refrigerant coil and the second refrigerant coil in the first mode, and water contained within exactly one of the first tank portion and the second tank portion being heated by refrigerant passing through the first refrigerant coil or the second refrigerant coil in the second mode.

2. The water heating system of claim 1, wherein the refrigerant flows sequentially first through the first refrigerant coil and second through the second refrigerant coil in both the first mode and the second.

3. The water heating system of claim 1, wherein the water contained within the second tank portion is cooled by refrigerant passing through the second refrigerant coil.

4. The water heating system of claim 1, wherein the first cylindrical outer wall of the first tank portion has a first inner diameter, the second cylindrical outer wall of the second tank portion has a second inner diameter, and the connecting pipe has a third inner diameter, both the first and the second inner diameters being at least five times the third inner diameter.

5. The water heating system of claim 1, wherein water contained within the first tank portion is heated by refrigerant passing through the first refrigerant coil in the second mode, the water heating system being further configured to operate in a third mode, water contained within the second tank portion being heated by refrigerant passing through the second refrigerant coil in the third mode and water contained within the first tank portion not being heated in the third mode.

6. The water heating system of claim 5, wherein refrigerant does not flow through the first refrigerant coil in the third mode.

7. The water heating system of claim 5, wherein the water heating system is configured to heat water contained within the first tank portion to a first setpoint temperature in the first mode and to heat water contained within the second tank portion to a second setpoint temperature lower than the first setpoint temperature in the third mode.

8. The water heating system of claim 1, wherein the hot water storage tank further comprises an inlet dip tube extending through the connecting pipe into an internal volume of the second tank portion to deliver water into the second tank portion.

9. The water heating system of claim 8, wherein the inlet dip tube and the connecting pipe together define an annular cross-section flow path between the first and second cylindrical tank portions.

10. The water heating system of claim 8, further comprising a heat trap arranged within the inlet dip tube, the heat trap configured to allow cold water to flow down into the second tank portion and to prevent warm water from flowing up from the second tank portion.

11. The water heating system of claim 10, wherein the heat trap is located along a portion of the inlet dip tube that extends through the connecting pipe.

12. The water heating system of claim 1, wherein the first tank portion is capped by a first domed head at a first end of the first cylindrical outer wall of the first tank portion and by a second domed head at a second end of the first cylindrical outer wall of the first tank portion, the first and the second domed heads each having an inwardly facing concave surface and an outwardly facing convex surface.

13. The water heating system of claim 12, wherein the hot water storage tank further comprises a water outlet stub connected to the first domed head.

14. The water heating system of claim 12, wherein the second tank portion is capped by a third domed head at a first end of the second cylindrical outer wall of the second tank portion and by a fourth domed head at a second end of the second cylindrical outer wall of the second tank portion, the third and the fourth domed heads each having an outwardly facing concave surface and an inwardly facing convex surface.

15. The water heating system of claim 14, wherein the connecting pipe extends between the second domed head and the third domed head.

16. The water heating system of claim 14, wherein the thermal insulation layer is in contact with the outwardly facing convex surface of the second domed head and the outwardly facing concave surface of the third domed head.

17. The water heating system of claim 16, wherein the thermal insulation layer has a constant thickness between the second domed head and the third domed head.

* * * * *